US009514687B2

(12) United States Patent
Koh et al.

(10) Patent No.: US 9,514,687 B2
(45) Date of Patent: Dec. 6, 2016

(54) IMAGE DISPLAYING METHOD AND DISPLAY DEVICE DRIVING THEREOF

(71) Applicant: Samsung Display Co., Ltd., Yongin (KR)

(72) Inventors: Jai-Hyun Koh, Hwaseong-si (KR); Kyungsu Lee, Ansan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 48 days.

(21) Appl. No.: 14/461,174

(22) Filed: Aug. 15, 2014

(65) Prior Publication Data

US 2015/0243223 A1 Aug. 27, 2015

(30) Foreign Application Priority Data

Feb. 25, 2014 (KR) ..... 10-2014-0022123

(51) Int. Cl.

| | |
|---|---|
| ***G09G 3/34*** | (2006.01) |
| ***G09G 3/36*** | (2006.01) |
| ***G09G 3/20*** | (2006.01) |

(52) U.S. Cl.

CPC ..... *G09G 3/3406* (2013.01); *G09G 3/20* (2013.01); *G09G 3/3611* (2013.01); *G09G 2330/00* (2013.01)

(58) Field of Classification Search

CPC ..... G09G 3/3406; G09G 3/3611; G09G 2330/00

USPC ..... 345/102, 690

See application file for complete search history.

(56) References Cited

U.S. PATENT DOCUMENTS

| | | | | |
|---|---|---|---|---|
| 2003/0189731 | A1* | 10/2003 | Chang | G06F 3/0321 358/3.28 |
| 2008/0036729 | A1* | 2/2008 | Mukuda | G09G 3/34 345/102 |
| 2008/0063254 | A1* | 3/2008 | Tanizaki | G06T 7/0004 382/141 |
| 2010/0278423 | A1* | 11/2010 | Itoh | G06T 5/008 382/169 |
| 2010/0309213 | A1* | 12/2010 | Chen | G09G 3/3406 345/589 |
| 2012/0092388 | A1* | 4/2012 | Kamon | G09G 3/3426 345/690 |
| 2012/0200484 | A1* | 8/2012 | Sankar | G09G 3/3406 345/102 |
| 2012/0327303 | A1* | 12/2012 | Sun | G09G 3/3406 348/687 |
| 2013/0222221 | A1* | 8/2013 | An | G09G 3/3426 345/102 |
| 2015/0123985 | A1* | 5/2015 | Abe | G06T 5/008 345/590 |

FOREIGN PATENT DOCUMENTS

| | | |
|---|---|---|
| EP | 2161709 | 3/2010 |
| JP | 2008-039801 | 2/2008 |
| KR | 10-0697386 | 3/2007 |
| WO | 2010/126103 | 4/2010 |

* cited by examiner

*Primary Examiner* — Amare Mengistu
*Assistant Examiner* — Jennifer Zubajlo
(74) *Attorney, Agent, or Firm* — H.C. Park & Associates, PLC

(57) ABSTRACT

A method of displaying an image on a display panel including pixels arranged in an m-by-n matrix (m and n being natural numbers), including measuring a complexity of image data based on an entropy or a most significant bit, the image data including a plurality of unit data corresponding to the pixels; and adjusting the amount of light supplied by a backlight unit according to the measured complexity of the image data.

6 Claims, 7 Drawing Sheets

IMAGE DISPLAYING METHOD AND DISPLAY DEVICE DRIVING THEREOF

CROSS-REFERENCE TO RELATED APPLICATION

This application claims priority from and the benefit of Korean Patent Application No. 10-2014-0022123 filed Feb. 25, 2014, which is hereby incorporated by reference for all purposes as if fully set forth herein.

BACKGROUND

Field

Exemplary embodiments relate to an image displaying method and a display device. More particularly, exemplary embodiments relate to an image displaying method capable of reducing power consumption and a display device including the same.

Discussion of the Background

A display device including a display panel, such as a liquid crystal display panel or an electrophoresis display panel, does not emit light spontaneously. Such an arrangement necessitates an external light source for supplying light, that is, a backlight unit. The backlight unit consists of a light source for generating light, and a light guide plate for guiding the light from the light source in the direction of the display panel.

The backlight unit requires power for supplying light to the display panel. For this reason, ongoing research is being conducted to reduce power consumption of the backlight unit.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a method of displaying an image such that the amount of backlight supplied to a display screen is adjusted according to the measured complexity of image data based on entropy or a most significant bit ("MSB") of the image data.

Additional aspects will be set forth in the detailed description which follows, and, in part, will be apparent from the disclosure, or may be learned by practice of the inventive concept.

An exemplary embodiment of the present invention discloses a method of displaying an image including image data on a display panel including pixels arranged in an m-by-n matrix (m and n being natural numbers), the method including: measuring a complexity of image data based on entropy or an MSB of the image data, the image data including a plurality of unit data corresponding to the pixels; and adjusting the amount of light supplied by a backlight unit according to the measured complexity of the image data.

An exemplary embodiment of the present invention also discloses a display device including a display panel having pixels arranged in an m-by-n matrix (m and n being natural numbers); a backlight unit configured to supply light to the display panel; and a driving portion including a plurality of unit data corresponding to the pixels. The driving portion measures a complexity by comparing entropies or MSBs of image data that is to be provided to the display panel and is to be displayed as an image. The driving portion adjusts the amount of light supplied by the backlight unit according to the measured complexity of the image data.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
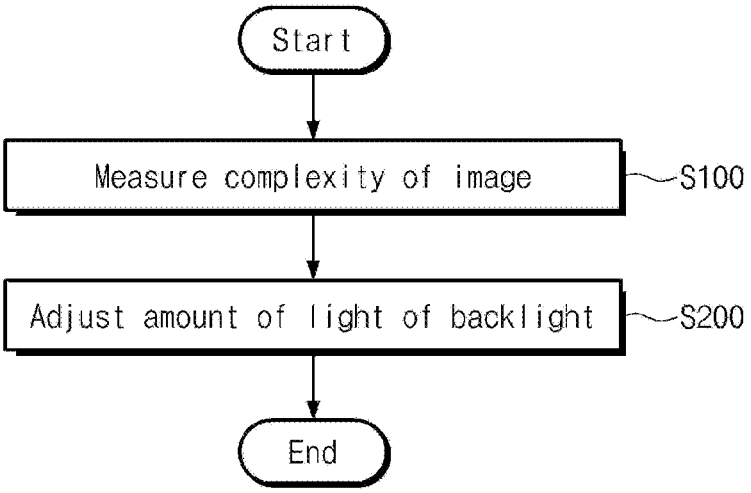
FIG. 1 is a flow chart schematically illustrating an image displaying method according to an exemplary embodiment of the inventive concept.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Below, an image displaying method according to an exemplary embodiment of the inventive concept will be more fully described with reference to accompanying drawings.

Referring to FIG. 1, an image displaying method according to an exemplary embodiment of the inventive concept includes measuring complexity of image (S100); and adjusting the amount of light supplied by a backlight unit (S200).

With an image displaying method of the inventive concept, the amount of light supplied by the backlight unit, when first image data having a first complexity is output, may be controlled to be smaller than the amount of light supplied by the backlight unit when second image data, having a second complexity less than the first complexity, is output. That is, it is possible to control the amount of light for image data having high complexity to be limited to a smaller maximum output.

Figure 2A:
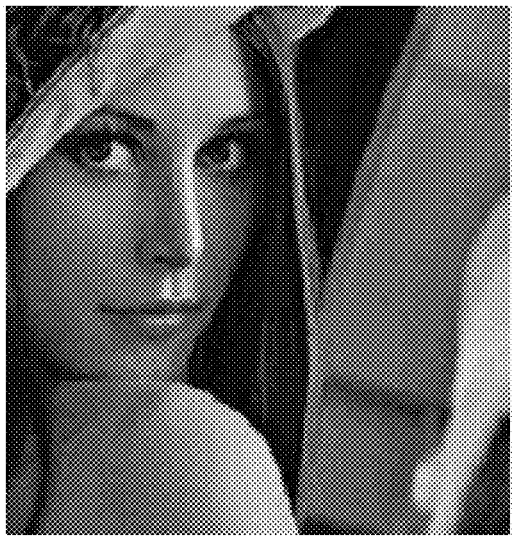
FIGS. 2A to 2C show images with different complexity.
Figure 2B:
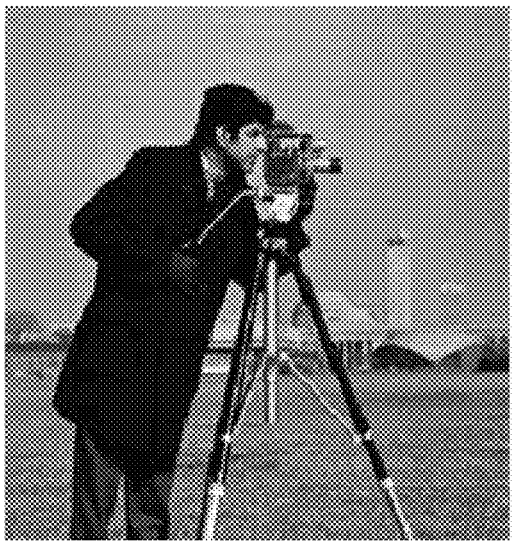
Figure 2C:
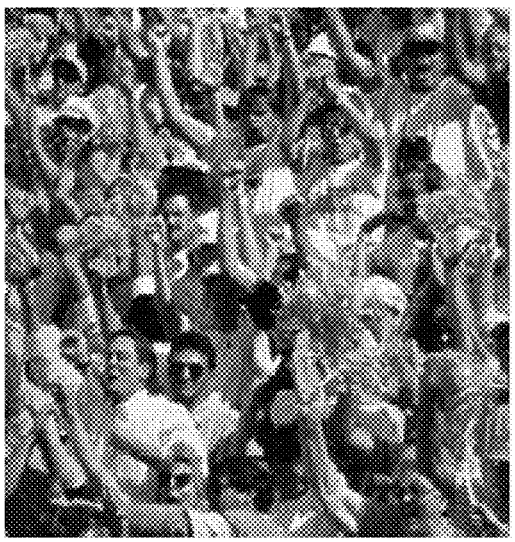

FIGS. 2A to 2C show images with different degrees of complexity. The image shown in FIG. 2A has the least complexity, and the image shown in FIG. 2C has the greatest complexity.

Figure 3:
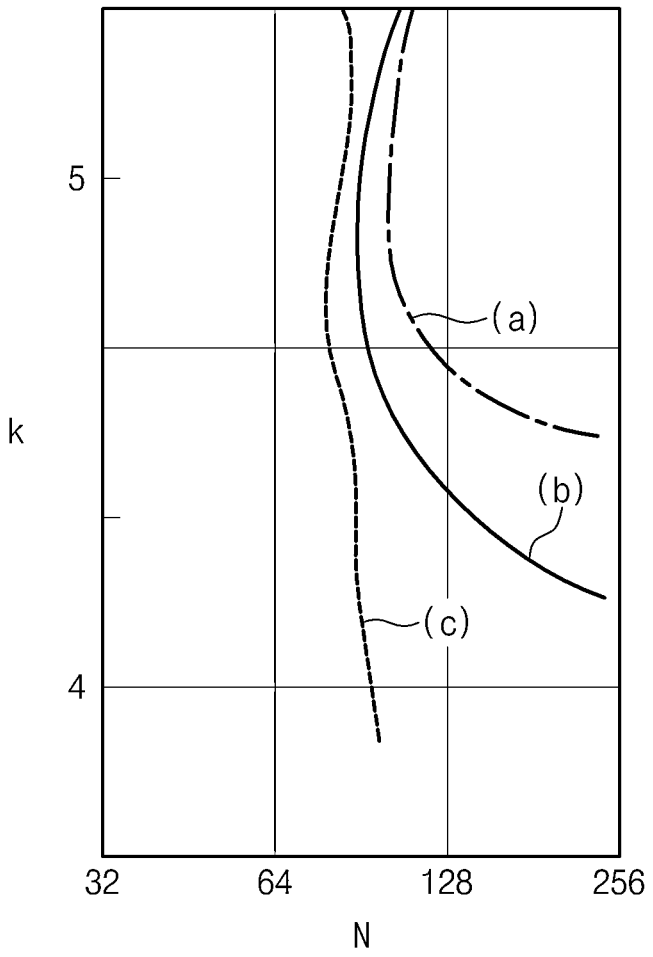
FIG. 3 is a graph showing a relationship between gray resolution (N) and spatial resolution (K) for the images shown in FIGS. 2A to 2C.
Figure 4:
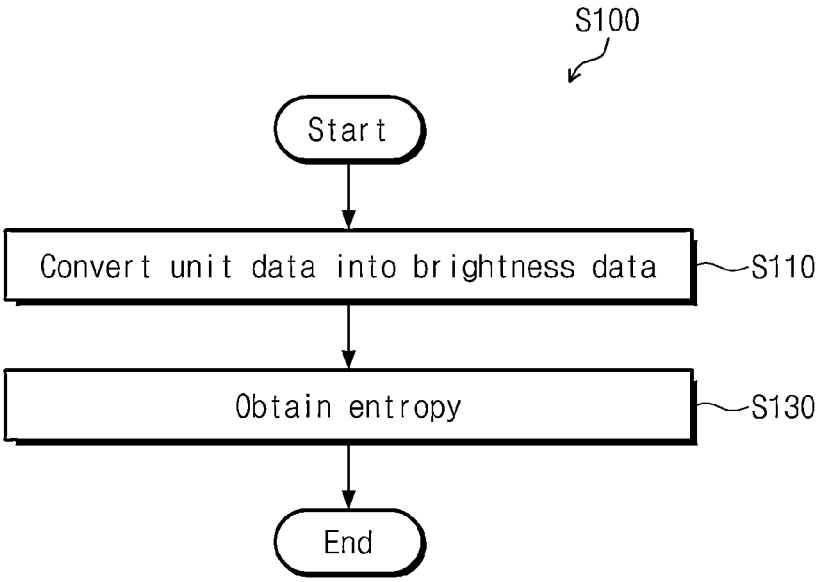
FIG. 4 is a flow chart schematically illustrating an operation of measuring complexity, according to an exemplary embodiment of the inventive concept.

FIG. 3 is a graph showing a relationship between gray resolution (N) and spatial resolution (K) regarding the images shown in FIGS. 2A to 2C.

Referring to FIGS. 2A to 2C and FIG. 3, gray resolution about the same spatial resolution may decrease in proportion to an increase in complexity of an image. Even if spatial resolution remains constant, gray resolution may vary remarkably in proportion to a change in complexity in the image. Accordingly, as the complexity of the image increases, a human's sensitivity to a change in brightness of the image may decrease. If the complexity decreases, a human's sensitivity to a change in brightness of an image may increase.

In the image displaying method according to an exemplary embodiment of the inventive concept, the amount of light may be reduced because of the reduced sensitivity when image data has a high level of complexity; and the amount of light may be increased because of the increased sensitivity when image data has a low level of complexity. This control scheme may make it possible to reduce power consumption of a display device.

The following steps (S100, S200) of measuring complexity and adjusting the amount of light of a backlight unit will be described.

Referring to FIGS. 1 and 4 to 6, in Step S100, the complexity of image data to be displayed on a display panel may be measured based on entropy or the most significant bit ("MSB") of the image data. The display panel may include pixels arranged in an m-by-n matrix (m and n are natural numbers).

In Step S100, for example, complexity may be measured by comparing results of measuring the entropy or MSB of the image data. However, according to other exemplary embodiments, other measures of complexity may be used.

The image data may include a plurality of unit data corresponding to the pixels.

A correspondence between the pixels and the plurality of unit data may be, but is not limited to, 1:1 or 1:n (n being an integer of 2 or more). An image displaying method according to an exemplary embodiment of the inventive concept will be described under the assumption that there is a 1:1 correspondence between the pixels and the plurality of unit data. The image data may include the plurality of unit data arranged in an m-by-n matrix (m and n being natural numbers). Also, unit data in the ith row and jth column may correspond to a pixel in the ith row and jth column.

Unit data in the ith row and (j+1)th column may correspond to a pixel in the ith row and (j+1)th column, and unit data in the (i+1)th row and jth column may correspond to a pixel in the (i+1)th row and jth column. Here, "i" is a natural number greater than "0" and less than "m", and "j" is a natural number greater than "0" and less than "n".

Each of the unit data may include red unit data, green unit data, and blue unit data. Each unit data may also include white unit data.

Step S110 includes converting the unit data into brightness data. The brightness data may contain red brightness data, green brightness data, and blue brightness data. The red brightness data may be a conversion value of the red unit data, the green brightness data may be a conversion value of the green unit data, and the blue brightness data may be a conversion value of the blue unit data.

Brightness data in the ith row and jth column may include red brightness data in the ith row and jth column, green brightness data in the ith row and jth column, and blue brightness data in the ith row and jth column.

Red brightness data in the ith row and jth column may be $(i, j, R)^{\gamma}$, green brightness data in the ith row and jth column may be $(i, j, G)^{\gamma}$, and blue brightness data in the ith row and jth column may be $(i, j, B)^{\gamma}$. "R", "G", and "B" may indicate red unit data, green unit data, and blue unit data, and "γ" may indicate the logarithm of a gamma curve.

Regarding the visual perception characteristic of a human, a brightness difference on a dark screen may be easily recognized, but a brightness difference on a light screen may not be easily recognized. Upon restoring of an image signal, a penetration ratio about gray resolution of image information needs be adjusted considering the visual perception characteristic of a human. This may be referred to "gamma correction". The gamma correction may be made to improve a characteristic of the image quality in a display. A value (hereinafter, referred to as "gamma value") used to perform the gamma correction may be designated by "γ". For example, the gamma value may be 2.2.

Figure 5:
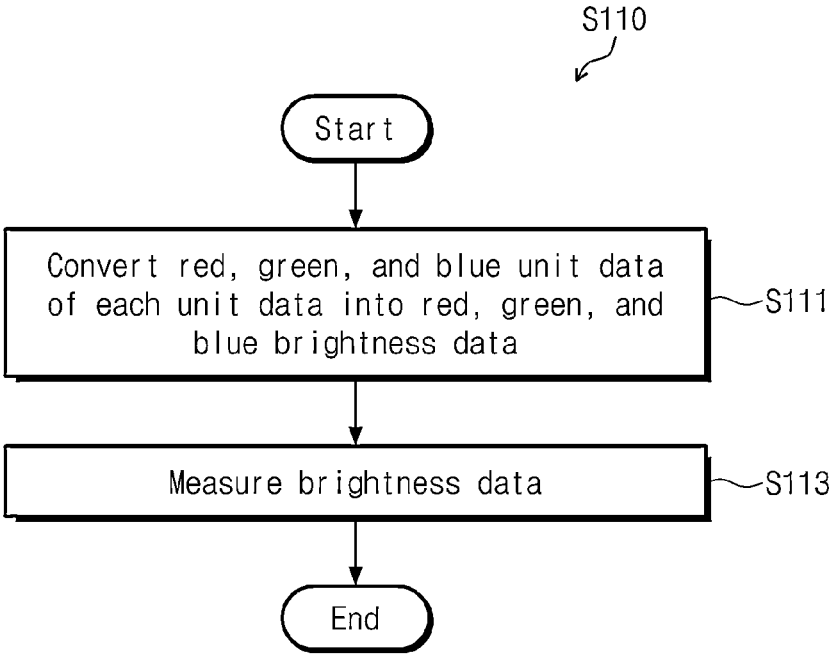
FIG. 5 is a flow chart schematically illustrating an operation of measuring brightness data, according to an exemplary embodiment of the inventive concept.
Figure 6:
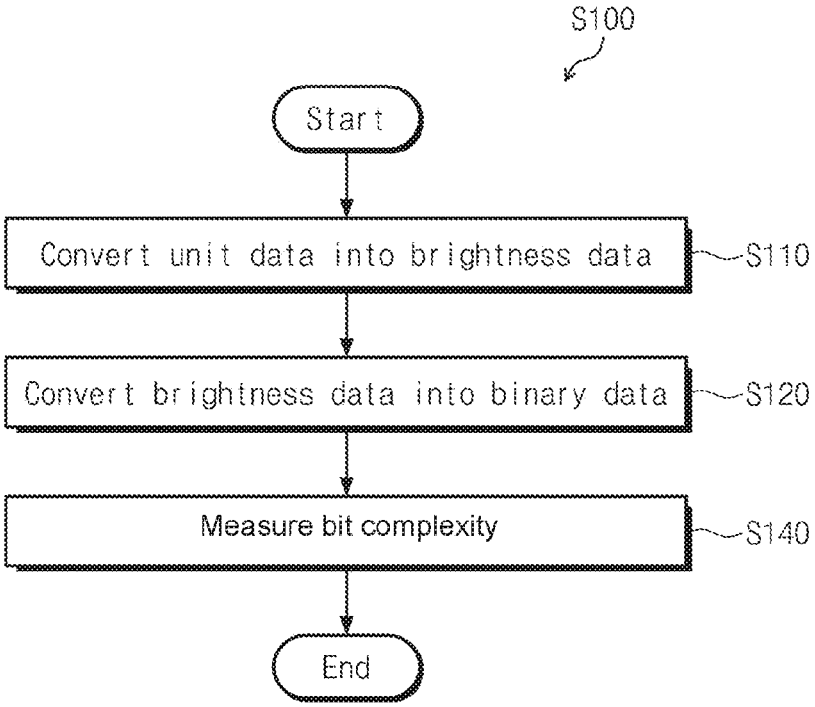
FIG. 6 is a flow chart schematically illustrating an operation of measuring complexity, according to an exemplary embodiment of the inventive concept.
Figure 7:
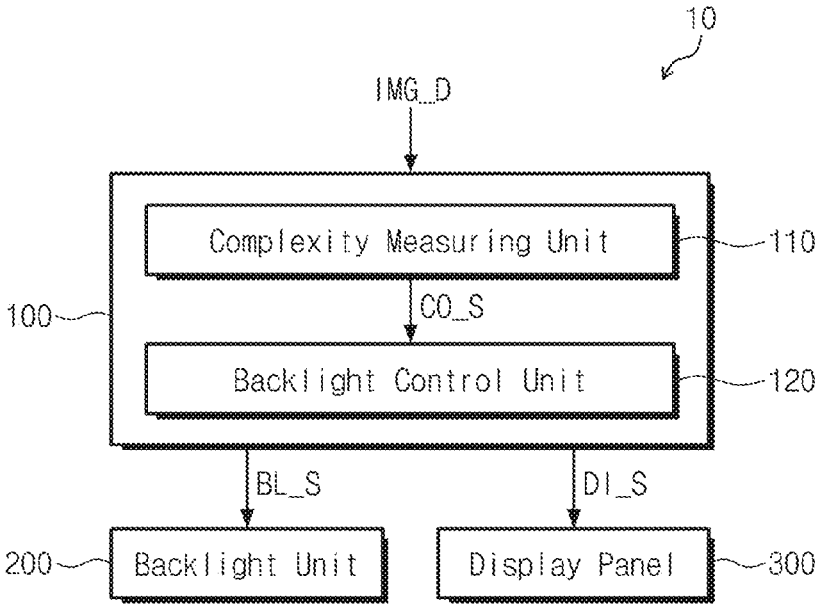
FIG. 7 is a block diagram schematically illustrating a display device according to an exemplary embodiment of the inventive concept.
Figure 8:
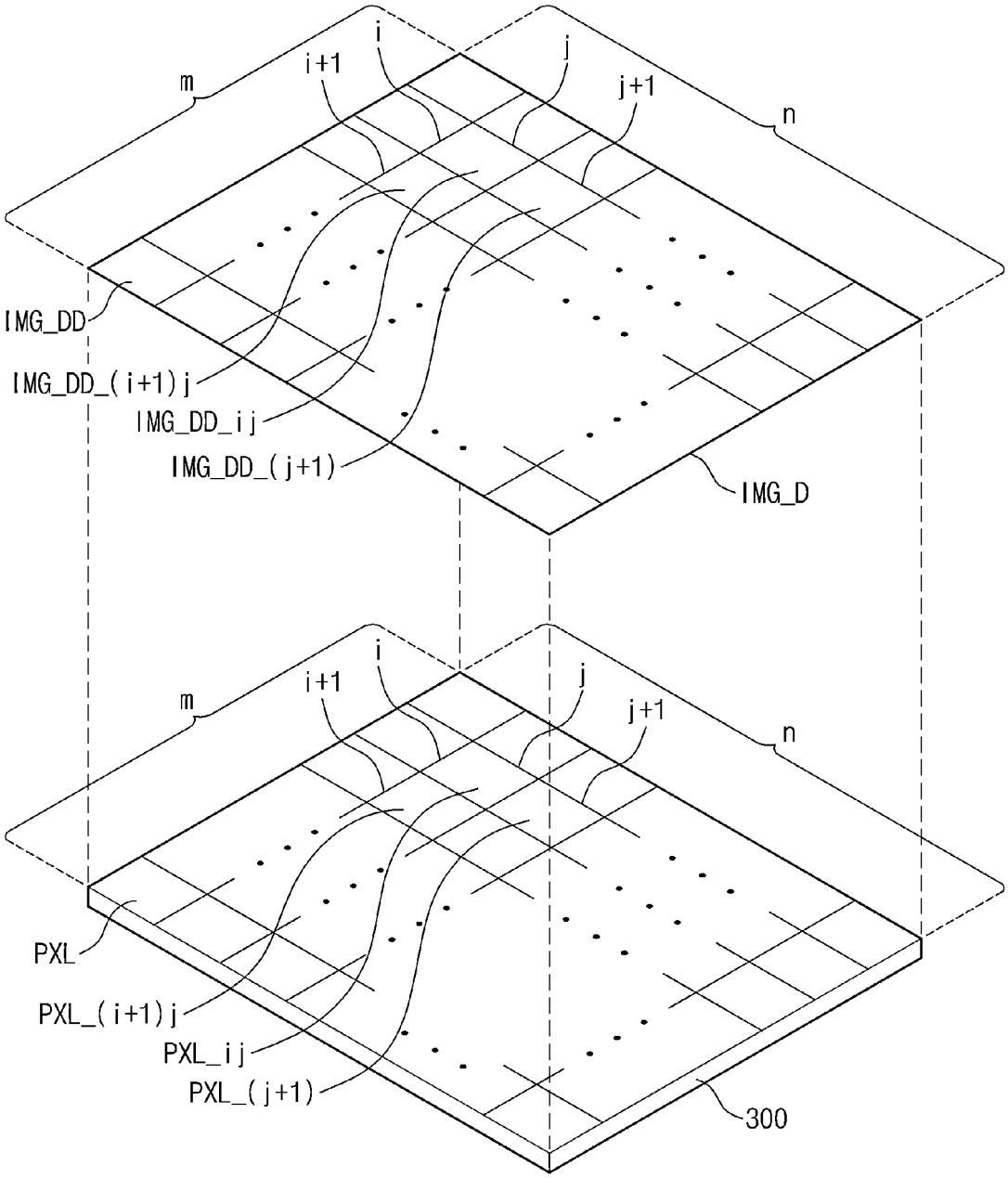
FIG. 8 is a perspective view schematically illustrating image data and a display panel, according to an exemplary embodiment of the inventive concept.
Figure 9:
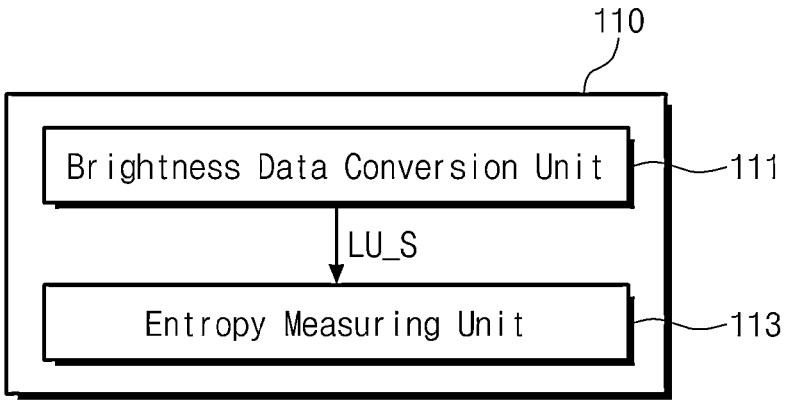
FIG. 9 is a block diagram schematically illustrating a complexity measuring portion according to an exemplary embodiment of the inventive concept.
Figure 10:
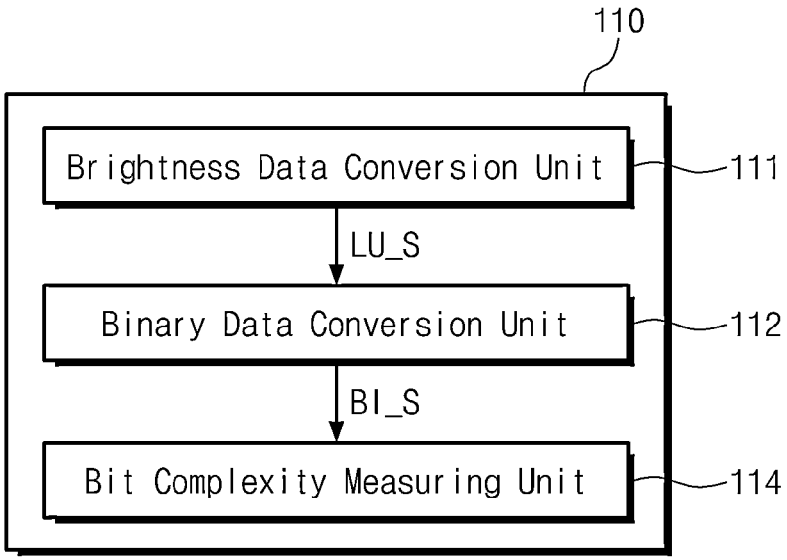
FIG. 10 is a block diagram schematically illustrating a complexity measuring portion according to another exemplary embodiment of the inventive concept.

Step S110 of converting brightness data includes converting red unit data, green unit data, and blue unit data of each unit data into red brightness data, green brightness data, and blue brightness data (S111); and measuring each brightness data (S113), as shown in FIG. 5.

In the Step S113, each brightness data may be measured using weights added to the red brightness data, the green brightness data, and the blue brightness data.

Each brightness data may be measured using, a conventional method. Brightness data Dij in the ith row and jth column is measured by the following Equation (1).

$$Dij=a\times(i,j,R)\gamma+b\times(i,j,G)\gamma+c\times(i,j,B)\gamma \quad (1)$$

In Equation (1), "a", "b", and "c" may be positive real numbers satisfying the conditions a+b+c=1 and b>a>c, where "a" is a weight of the red brightness data, "b" is a weight of the green brightness data, and "c" is a weight of the blue brightness data, and a sum of such weights may be normalized to "1". The green brightness data may have the greatest weight, and the blue brightness data may have the smallest weight. For example, "a", "b", and "c" may be 0.2, 0.7, and 0.1, respectively.

Step S100 further includes obtaining entropy based on the probability that adjacent brightness data have the same value. Locations of adjacent brightness data may not be limited, but an image displaying method according to an exemplary embodiment of the inventive concept will be described assuming that in the brightness data in the ith row and jth column, the adjacent brightness data includes brightness data in the ith row and (j+1)th column and brightness data in the (i+1) row and jth column.

The entropy may be obtained using, a general method. For example, the entropy may be calculated by the following Equation (2).

$$\sum_{(i,j)} P(X_{(i,j)})\log_2 P(X_{(i,j)}) \quad (2)$$

In Equation (2), P(X(i,j)) is a probability mass function, and indicates the probability that brightness data in the ith row and (j+1)th column is equal to brightness data in the (i+1)th row and jth column. A method of calculating P(X(i, j)) may be the same as a method of calculating a conventional probability mass function, and X(i,j) means brightness data in the ith row and jth column.

When "i" is a natural number satisfying the condition 0<i<m, and "j" is a natural number satisfying the condition 0<j<n, the entropy may be a sigma value of i×j entropy. The i×j entropy En may be obtained by the following Equation (3).

$$En=P(x_{(i,j)})\log_2 P(x_{(i,j)}) \quad (3)$$

The entropy may be divided into periods, and the amount of light may be adjusted to correspond to divided portions of the entropy, respectively. For example, the entropy may be divided into periods, as shown in the following Table 1. A maximum value of the amount of light of a backlight unit is assumed to be 1.

TABLE 1

| | Entropy (En) | | | | |
|---|---|---|---|---|---|
| | 0 ≤ En < 1 | 1 ≤ En < 2 | 2 ≤ En < 3 | 3 ≤ En < 4 | 4 ≤ En |
| Amount of light of backlight unit | 1 | 0.95 | 0.90 | 0.85 | 0.80 |

The amount of light may be adjusting using, a conventional method. In step S200 of adjusting the amount of light, a duty ratio may be adjusted, or a pulse level of a backlight signal may be provided to the backlight unit.

For example, if the entropy is high, a duty ratio of the backlight signal may be controlled to have a small value. Similarly, if the entropy is high, a pulse level of the backlight signal may be controlled to have a small value.

Step S100 further comprises converting each brightness data into binary data (S120); and measuring bit complexity CPLXnom (S140). The bit complexity CPLXnom may be calculated by comparing MSBs of adjacent binary data of binary data.

In step S120, each brightness data may be converted into 8-bit or 16-bit data as binary data. For example, i×j brightness data is converted into i×j binary data, i×(j+1) brightness data is converted into i×(j+1) binary data, and (i+1)×j brightness data is converted into (i+1)×j binary data.

The bit complexity may be measured according to the following Equations (4) to (6).

$$CPLX_{nom} = \frac{CPLX}{CPLX_{max}} \quad (4)$$

$$CPLX_{max} = 2 \times m \times n \quad (5)$$

$$CLPX = \sum |BP(i, j) - BP(i, j+1)| + \sum |BP(i, j) - BP(i+1, j)| \quad (6)$$

In Equation (6), BP(i,j) is an MSB of i×j binary data, BP(i,j+1) is an MSB of i×(j+1) binary data, and BP(i+1,j) is an MSB of (i+1)×j binary data. Because a variation in binary data is greatest when the MSB varies, comparison of MSBs of binary data in Equation (6) is appropriate.

The MSB of the binary data may have a value of "0" or "1", so |BP(i, j)−BP(i, j+1)| may have a value of "0" or "1". Also, |BP(i, j)−BP(i+1, j)| may have a value of "0" or "1". A maximum value of |BP(i, j)−BP(i, j+1)|+|BP(i, j)−BP(i+1, j)| may be 2, and a value of bit complexity CPLXnom may be 2*m*n because "i" is a natural number satisfying the condition as 0<i<m, and "j" is a natural number satisfying the condition 0<j<n. Thus, the bit complexity CPLXnom may be decided according to Equations (4), (5), and (6).

Thus, the amount of light supplied by the backlight unit may be adjusted according to the complexity of the image.

The bit complexity may be divided into periods, and the amount of light may be adjusted to correspond to the divided portions, respectively. For example, the bit complexity may be divided as shown in the following Tables (2) and (3), in which it is assumed that a maximum value of the amount of light supplied by a backlight unit is 1.

TABLE 2

| | CPLXnom | | | | |
|---|---|---|---|---|---|
| | 0 ≤ CPLXnom < 0.2 | 0.2 ≤ CPLXnom < 0.4 | 0.4 ≤ CPLXnom < 0.6 | 0.6 ≤ CPLXnom < 0.8 | 0.8 ≤ CPLXnom < 1.0 |
| Amount of light | 1 | 0.95 | 0.90 | 0.85 | 0.80 |

TABLE 3

| | CPLXnom | | | | |
|---|---|---|---|---|---|
| | 0 ≤ CPLXnom < 0.02 | 0.02 ≤ CPLXnom < 0.04 | 0.04 ≤ CPLXnom < 0.06 | 0.06 ≤ CPLXnom < 0.08 | 0.08 ≤ CPLXnom |
| Amount of light | 1 | 0.95 | 0.90 | 0.85 | 0.80 |

The amount of light may be adjusted using a conventional method, but is not so limited. In Step S200 of adjusting the amount of light, a duty ratio or a pulse level of a backlight signal to be provided to the backlight unit may be adjusted.

For example, if the entropy is high, a duty ratio of the backlight signal may be controlled to have a small value. Similarly, if the entropy is high, a pulse level of the backlight signal may be controlled to have a small value.

In the image displaying method according to an exemplary embodiment of the inventive concept, power consumption of a display device may be reduced by measuring the complexity of image data and adjusting the amount of light supplied by a backlight unit according to the measured complexity.

Below, a display device according to another exemplary embodiment of the inventive concept will be described. The description below of the display device and the above-described image displaying method may be focused on the differences thereof, and contents not described below may comply with the image displaying method, according to an exemplary embodiment of the inventive concept.

Referring to FIGS. 7 to 10, a display device 10 according to an exemplary embodiment of the inventive concept includes a display panel 300, a backlight unit 200, and a driving portion 100.

A non-luminous display panel, which requires a separate backlight unit 200, may be used as the display panel. For example, there may be used a variety of display panels: a liquid crystal display panel and an electrophoretic display panel. The inventive concept will be described assuming that the display panel 300 is a liquid crystal display panel.

The display panel 300 includes pixels PXL arranged in an m-by-n matrix (m and n are natural numbers). The pixels PXL may be defined, for example, by gate lines (not shown) and data lines (not shown).

The display panel 300 may have a rectangular plate shape. The display panel 300 may include a lower substrate (not shown), an upper substrate (not shown) opposite the lower substrate, and a liquid crystal layer (not shown) formed between the lower substrate and the upper substrate.

The display panel 300 displays images in response to a display signal DI_S provided from the driving portion 100. The display signal DI_S may include, for example, a gate signal (not shown) and a gray scale voltage (not shown). The gate signal may be output from a gate driver (not shown) to drive the gate lines. The gray scale voltage may be output from a data driver (not shown) to drive the data lines.

The backlight unit 200 supplies a light to the display panel 300. The backlight unit 200 may include a light source unit (not shown) and a light guide plate (not shown). The light source unit provides a light to the light guide plate. The light source unit may include at least one light source (not shown) and a circuit substrate (not shown) mounted on one surface of the light source and configured to apply a power to the light source. The light guide plate may guide and output a light provided from the light source unit.

The backlight unit 200 adjusts the amount of light supplied in response to a backlight signal BL_S provided from the driving portion 100. This will be more fully described later.

The driving portion 100 may include a plurality of unit data IMG_DD corresponding to the pixels PXL. The driving portion 100 may measure complexity of the image data by comparing entropies or MSBs of image data IMG_DD that is to be provided to the display panel 300 and is to be displayed as an image. The driving portion 100 may adjust the amount of light supplied by the backlight unit 200 according to the measured complexity of the image data IMG_DD.

Under a control of the driving portion 100, the amount of light supplied by the backlight unit 200 when first image data with first complexity is output may be smaller than the amount of light supplied by the backlight unit when second image data with second complexity less than the first complexity is output.

The driving portion 100 includes a complexity measuring unit 110 and a backlight control unit 120. The complexity measuring unit 110 measures complexity of image data IMG_D. The complexity measuring unit 110 provides the backlight control unit 120 with a complexity signal CO_S as a result of measuring the complexity.

The image data IMG_D includes a plurality of unit data IMG_DD corresponding to the pixels PXL.

The pixels PXL may correspond to the plurality of unit data at a ratio of 1:1 or 1:n (n being an integer of 2 or more). A display device according to an exemplary embodiment of the inventive concept will be described assuming that a correspondence between the pixels and the plurality of unit data may be 1:1. The image data IMG_D may include the plurality of unit data IMG_DD arranged in an m-by-n matrix (m and n being natural numbers). Also, unit data IMG_DD_ij in the ith row and jth column may correspond to a pixel PXL_ij in the ith row and jth column, and unit data IMG_DD_(i+1)j in the (i+1)th row and jth column may correspond to a pixel PXL_(i+1)j at the (i+1)th row and jth column. Here, "i" is a natural number satisfying the condition $0<i<m$, and "j" is a natural number satisfying the condition $0<j<n$.

The complexity measuring unit 110 may include a brightness data conversion unit 111. The brightness data conversion unit 111 converts each unit data IMG_DD into brightness data. Also, the brightness data conversion unit 111 provides a brightness data signal LU_S to the entropy measuring unit 113.

Each brightness data may include red brightness data, green brightness data, and blue brightness data. The red brightness data may be a conversion value of the red unit data, the green brightness data may be a conversion value of the green unit data, and the blue brightness data may be a conversion value of the blue unit data.

Unit data IMG_DD_ij in the ith row and jth column may correspond to a pixel PXL_ij int the ith row and jth column. Unit data IMG_DD_ij in the ith row and jth column may be converted into brightness data at the ith row and jth column.

Brightness data at the ith row and jth column may include red brightness data in the ith row and jth column, green brightness data in the ith row and jth column, and blue brightness data in the ith row and jth column. Here, "i" is a natural number satisfying the condition $0<i<m$, and "j" is a natural number satisfying the condition $0<j<n$.

Red brightness data in the ith row and jth column may be $(i, j, R)^{\gamma}$, green brightness data in the ith row and jth column may be $(i, j, G)^{\gamma}$, and blue brightness data in the ith row and jth column may be $(i, j, B)^{\gamma}$. "R", "G", and "B" may indicate red unit data, green unit data, and blue unit data, and $^{\gamma}$ may indicate logarithm of a gamma curve.

Brightness data Dij in the ith row and jth column is measured by the above-described Equation (1).

In the above-described Equation (1), "a", "b", and "c" may be positive real numbers satisfying the conditions $a+b+c=1$, $b>a>c$, where "a" is a weight of the red brightness data, "b" is a weight of the green brightness data, and "c" is a weight of the blue brightness data, and a sum of such weights may be normalized to"1". The green brightness data may have the greatest weight, and the blue brightness data may have the smallest weight. For example, "a", "b", and "c" may be 0.2, 0.7, and 0.1, respectively.

The complexity measuring unit 110 further comprises the entropy measuring unit 113. The entropy measuring unit 113 is provided with a brightness data signal LU_S from the brightness data conversion unit 111. The entropy measuring unit 113 obtains an entropy based on the probability that adjacent brightness data of brightness data have the same value. Locations of adjacent brightness data may not be limited, but a display device 10 according to an exemplary embodiment of the inventive concept will be described assuming that the brightness data in the ith row and jth column, the adjacent brightness data includes brightness data in the ith row and (j+1)th column and brightness data in the (i+1) row and jth column.

The entropy may be obtained using the above-described Equation (2).

In the equation (2), P(X(i,j)) is a probability mass function, and indicates the probability that brightness data in the ith row and (j+1)th column is equal to brightness data in the (i+1)th row and jth column. A method of calculating P(X(i, j)) may be the same as a method of calculating a conventional probability mass function, and X(i,j) means brightness data in the ith row and jth column.

That is, when "i" is a natural number satisfying the condition $0<i<m$, and "j" is a natural number satisfying the condition $0<j<n$, the entropy may be a sigma value of i×j entropy. The i×j entropy En may be obtained by the above-described Equation (3).

The driving portion 100 includes the backlight control portion 120. The backlight control portion 120 adjusts the amount of light in response to a backlight signal BL_S provided from the complexity measuring unit 110.

The entropy may be divided into periods, and the amount of light may be adjusted to correspond to divided portions of the entropy, respectively. For example, if the entropy is high, a duty ratio of the backlight signal BL_S may be controlled to have a small value. Also, if the entropy is high, a pulse level of the backlight signal BL_S may be controlled to have a small value.

Meanwhile, the complexity measuring unit 110 further includes a binary data conversion unit 112 and a bit complexity measuring unit 114. The binary data conversion unit 112 converts each brightness data into binary data and provides a binary data signal BI_S to the bit complexity measuring unit 114. The bit complexity measuring unit 114 receives the binary data signal BI_S from the binary data conversion unit 112 and obtains bit complexity CPLXnom by comparing MSBs of adjacent binary data of binary data.

For example, i×j brightness data is converted into i×j binary data, i×(j+1) brightness data is converted into i×(j+1) binary data, and (i+1)×j brightness data is converted into (i+1)×j binary data.

The bit complexity CPLXnom may be calculated using the above-described Equations (4) to (6).

In the above-described Equation (6), BP(i,j) is an MSB of i×j binary data, BP(i,j+1) is an MSB of i×(j+1) binary data, and BP(i+1,j) is an MSB of (i+1)×j binary data.

Since a variation in binary data is greatest when the MSB varies, comparison of MSBs of binary data in the above-described Equation (6) may be made.

The backlight control unit adjusts the amount of light supplied by the backlight unit 200. For example, the bit complexity may be divided into periods, and the amount of light may be adjusted to correspond to the periods. For example, if the bit complexity is high, a duty ratio of the backlight signal BI_S may be decreased. Similarly, if the bit complexity is high, a pulse level of the backlight signal BI_S may be decreased.

The display device according to an exemplary embodiment of the inventive concept may reduce power consumption by measuring complexity of image data and adjusting the amount of light supplied by a backlight unit.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A display device comprising:

a display panel comprising pixels arranged in an m-by-n matrix (m and n being natural numbers);

a backlight unit configured to supply light to the display panel; and a driving portion comprising a plurality of unit data corresponding to the pixels, wherein:

the driving portion comprises:

a complexity measuring unit configured to measure complexity by comparing entropies or most significant bits (MSBs) of image data that is to be provided to the display panel and is to be displayed as an image; and a backlight control unit configured to adjust the amount of light supplied by the backlight unit according to the complexity of the image data; and the complexity measuring unit comprises:

a brightness data conversion unit configured to convert each unit data into brightness data;

a binary data conversion unit configured to convert each brightness data into binary data; and a bit complexity measuring unit configured to measure a bit complexity CPLXnom by comparing MSBs of adjacent binary data of the binary data.

2. The display device of claim 1, wherein, under a control of the driving portion, the amount of light supplied by the backlight unit to view first image data with a first complexity value is smaller than the amount of light supplied by the backlight unit to view second image data with a second complexity value less than the first complexity value.

3. The display device of claim 1, wherein:

i×j brightness data comprises i×j red brightness data, i×j green brightness data, and i×j blue brightness data;

the i×j red brightness data is $(i, j, R)^{\gamma}$, the i×j green brightness data is $(i, j, G)^{\gamma}$, and the i×j blue brightness data is $(i, j, B)^{\gamma}$, "i" is a natural number satisfying such a condition as $0<i<m$ and "j" is a natural number satisfying the condition $0<j<n$, and wherein "R", "G", and "B" indicate red unit data, green unit data, and blue unit data, respectively, and "γ" indicates logarithm of a gamma curve.

4. The display device of claim 3, wherein i×j brightness data is calculated by:

$$a\times(i,j,R)\gamma+b\times(i,j,G)\gamma+c\times(i,j,B)\gamma$$

wherein, "a", "b", and "c" may be positive real numbers satisfying the conditions $a+b+c=1$ and $b>a>c$.

5. The display device of claim 4, wherein the complexity measuring unit further comprises an entropy measuring unit configured to obtain an entropy based on the probability that adjacent brightness data of the brightness data is the same, and wherein an entropy value is obtained by:

$$\sum_{(i,j)} P(X_{(i,j)})\log_2 P(X_{(i,j)})$$

wherein $P(X_{(i,j)})$ is a probability mass function and indicates the probability that i×(j+1) brightness data is equal to (i+1)×j brightness data, and X(i,j) means i×j brightness data.

6. The display device of claim 4, wherein the bit complexity CPLXnom is calculated by:

$$CPLX_{nom} = \frac{CPLX}{CPLX_{max}}$$

$$CPLX_{max} = 2\times m\times n$$

$$CLPX = \sum |BP(i,\ j) - BP(i,\ j+1)| + \sum |BP(i,\ j) - BP(i+1,\ j)|$$

wherein BP(i,j) is an MSB of i×j binary data.

* * * * *